United States Patent [19]

Oikawa

[11] 4,047,847

[45] Sept. 13, 1977

[54] MAGNETICALLY DRIVEN CENTRIFUGAL PUMP

[75] Inventor: Kunihiro Oikawa, Hatoyama, Japan

[73] Assignee: Iwaki Co., Ltd., Tokyo, Japan

[21] Appl. No.: 669,827

[22] Filed: Mar. 24, 1976

[30] Foreign Application Priority Data

Mar. 26, 1975 Japan ..... 50-36324

[51] Int. Cl.[2] ..... F04B 35/04; F04B 39/02

[52] U.S. Cl. ..... 417/370; 417/420

[58] Field of Search ..... 417/420, 357, 369, 370, 417/368, 366, 371; 415/104, 106, 111, 112, 110

[56] References Cited

U.S. PATENT DOCUMENTS

| | | | |
|---|---|---|---|
| 2,259,361 | 10/1941 | Vorkauf | 415/112 |
| 2,448,717 | 9/1948 | Jeffcock | 415/112 |
| 2,669,187 | 2/1954 | Guyer | 417/357 |
| 3,118,384 | 1/1964 | Sence et al. | 417/370 |
| 3,186,513 | 6/1965 | Dunn et al. | 417/370 |
| 3,220,350 | 11/1965 | White | 417/370 |
| 3,280,750 | 10/1966 | White | 417/357 |
| 3,826,938 | 7/1974 | Filer | 417/420 |
| 3,877,844 | 4/1975 | Klaus et al. | 417/420 |

*Primary Examiner*—Carlton R. Croyle
*Assistant Examiner*—L. J. Casaregola

[57] ABSTRACT

A magnetically driven centrifugal pump comprises a split plate for dividing a space within a housing into two parts-impeller chamber and rotor chamber, a shaft supported by an inner wall of said rotor chamber and the split plate and having an internal rotor, an external rotor disposed outside the housing to magnetically drive the internal rotor, a passage means for permitting the communication between the impeller chamber and rotor chamber, and a restricting means for reducing the pressure of a fluid passing through said passage means.

15 Claims, 5 Drawing Figures

MAGNETICALLY DRIVEN CENTRIFUGAL PUMP

BACKGROUND OF THE INVENTION

This invention relates to a magnetically driven centrifugal pump.

Generally, this type of pump conprises a sealed housing having a chamber formed therein, an external rotor rotatably disposed outside the housing and having a plurality of permanent magnets, an internal rotor rotatably retained by a shaft provided within the housing and having a plurality of permanent magnets, and an impeller rotatably retained by said shaft. That impeller chamber section of said chamber which has the impeller received therein is connected to that rotor chamber section of said chamber which has the internal rotor received therein, so as to permit the free passage of a fluid between both sections. The shaft is supported at both ends, respectively, by an inner wall of the rotor chamber section and a spider member provided for the impeller chamber section. Bearing members for the shaft are cooled by the fluid flowing thereto from the impeller chamber.

This type of conventional pump has the following drawbacks.

a. Since the impeller chamber section is directly connected to the rotor chamber, the mutually opposite axial thrusts acting on the impeller are difficultly balanced. Further, since, in the case of high pressure being produced within the impeller chamber section, this pressure directly acts on the wall of the rotor chamber, this wall should be formed thick and firm. This runs counter to the specific demand that the wall of the rotor chamber section must be formed as thin as possible for purpose of passing magnetic flux therethrough.

b. Since the spider member supporting the shaft is provided at the inlet side of the impeller chamber section, cavitation occurs within the impeller chamber section, so that the cooling efficiency of the shaft bearing section is decreased simultaneously with production of noises and occurrence of vibration. Further, the shaft must be so designed as to have a large span. This is very disadvantageous for this type of pump since the shaft must be formed or inorganic material such as $Al_2O_3$ in order to have high corrosion resistance.

Accordingly, the object of the invention is to provide a magnetically driven centrifugal pump in which mutually opposite axial thrusts can be readily balanced and which can be prevented from damaging the wall of the rotor chamber.

The magnetically driven centrifugal pump according to the invention comprises a split plate for dividing a space within a sealed housing into two parts-impeller chamber and motor chamber, a passage means for guiding a fluid within the impeller chamber into the rotor chamber, and a restricting means disposed in the passage means to reduce the fluid pressure within the passage means. A shaft retaining the rotor and impeller is extended through the slit plate and is rotatably supported by a bearing member provided for the inner wall of the rotor chamber and a bearing member provided for the split plate.

The pressure within the rotor chamber is maintained always lower by the restricting means than that within the impeller chamber. Within the rotor chamber, the mutually opposite axial thrusts acting on the rotor are balanced depending upon the relationship between the forward and rearward regions of the rotor. Within the impeller chamber, the mutually opposite axial thrusts acting on the impeller are balanced depending upon the relationship between the forward and rearward regions of the impeller. In this way, the balance between the axial thrusts within the rotor chamber and the balance between the axial thrusts within the impeller chamber are independently achieved, so that all axial thrusts can be readily balanced. For instance, even where, upon a rapid stop of the pump, a so-called water hammer phenomenon occur within the impeller chamber, this phenomenon is weakened by the restricting means to have no direct effect upon the interior of the rotor chamber. For this reason, the peripheral wall of the rotor chamber can be formed relatively thin, whereby the efficiency of the magnetic connection between an internal rotor within the rotor chamber and an external rotor outside the same can be increased.

The shaft is supported by the bearing members at its rearward end portion and its intermediate portion, respectively. Accordingly, the shaft portion between the bearing members becomes shorter than in the case of the conventional shaft supported at its both forward and rearward ends. Therefore, a stress acting on the shaft becomes small to decrease possible damages to the shaft. Further, since the present invention eliminates the necessity of providing the conventional spider member supporting the forward end of the shaft, cavitation is less likely to occur within the impeller chamber, whereby to increase the life of the pump and the cooling efficiency of the shaft-supporting sections.

DETAILED DESCRIPTION OF THE PREFERRED EMBODIMENTS

Figure 1:
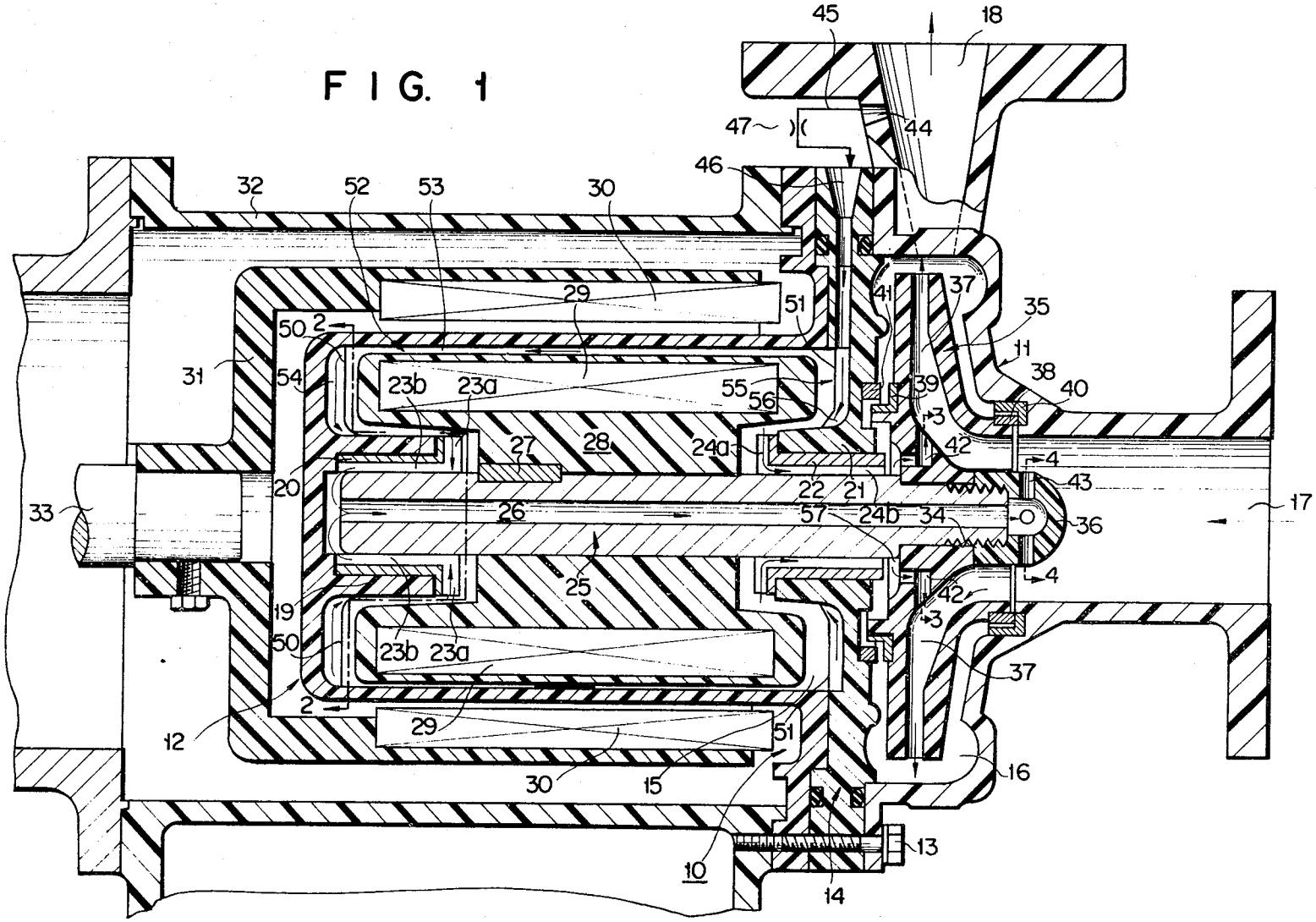
FIG. 1 is a longitudinal sectional view of a magnetically driven centrifugal pump according to an embodiment of the invention.
Figure 2:
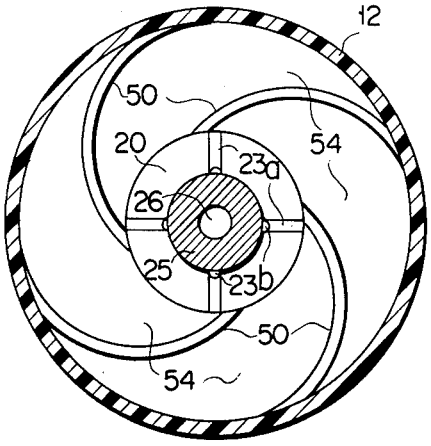
FIGS. 2, 3 and 4 are sectional views taken along the lines 2—2, 3—3 amd 4—4 of FIG. 1, respectively.
Figure 3:
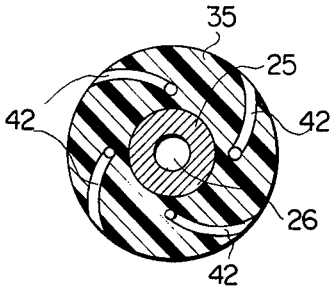
Figure 4:
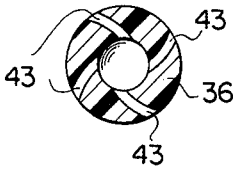

A magnetically driven centrifugal pump shown in FIGS. 1 to 4 has a sealed housing 10, which is comprised of a forward housing half 11 and a rearward housing half 12 which are fluid-tightly coupled and fixed to each other by bolts 13 (in FIG. 1, only one bolt is shown). Both housing halves firmly sandwich a split plate 14 therebetween. The split plate 14 divides a space within the housing 10 into two parts-rotor chamber 15 and impeller chamber 16. The housing halves 11, 12 and the split plate 14 are each formed of synthetic resin such as fluorine-contained resin, that is, nonmagnetic material.

At a central part of the forward housing half 11 is provided an inlet 17 for introducing fluid into the impeller chamber 16. At a peripheral part of the forward housing half 11 is provided an outlet 18 for discharging fluid from the impeller chamber 16.

At a central part of a rearward wall of the rearward housing half 12 is provided a cylindrical projection 19, which is fixedly fitted with a first radial bearing ring 20 formed of carbon or polyfluoroethylene. Further, at a central part of the split plate 14 is provided a boss 21, which is fixedly fitted with a second radial bearing ring 22 formed of carbon or polyfluoroethylene. The bearing rings 20 and 22 have a plurality of radial grooves **23*a* and 24*a*, and axial grooves 23*b* and 24*b*, respectively. A ceramic-made shaft 25 consisting mainly of $Al_2O_3$ (in this embodiment, the proportion of $Al_2O_3$ is 99.6%) is rotatably supported at its rearward end portion and its intermediate portion by the bearing rings 20 and 22, respectively, and is formed therethrough with a through hole 26. Within the rotor chamber 15 an internal rotor 28 formed of synthetic resin is fixed to the shaft 25 through a key 27. On the outer periphery of the rotor are provided a pluraltiy of permanent magnets 29 which are circumferentially spaced apart from each other. The outer peripheral wall of he rearward housing half 12 is surrounded by an external rotor 31 having a plurality of permanent magnets 30. The rotor 31 is fixed to that motor shaft 33 of a known electric motor (not shown) which is attached to an external housing 32, so as to be rotated by the shaft 33**.

A plurality of guide vanes 50 are integrally formed on that inner wall of the rearward housing half 12 which is faced to a rearward end face of the internal motor 28. Each guide vane 50 assumes a logarithmic spiral (FIG. 2) so that the fluid rotating jointly with the internal rotor 28 may flow toward the shaft 25. Further, a plurality of guide vanes 51 are integrally formed also on that wall portion of the split plate 14 which is faced to a forward end face of the internal rotor 28. The guide vane 51 also assumes a logarithmic spiral similarly.

A forward portion of the shaft 25 is passed through the bearing rind 22 to project into the impeller chamber 16 and the outer periphery of the foremost end portion thereof is formed with an external thread 34. Within the impeller chamber 16, the shaft 25 fixedly retains an impeller 35 which is held in a specified position by a semispherical, internally threaded cap 36 fitted over the external thread 34. The impeller 35 has a plurality of pumping passage 37 each opened to its forward face and peripheral face. To forward side and rearward side parts of the impeller 35 are fixed thrust rings 38 and 39, respectively. To the housing half 11 and split plate 14 are fixed thrust rings 40 and 41, respectively, in such a manner as to oppose the thrust rings 38 and 39. The interspaces between the rings 38 and 40 and between the rings 30 and 41 are so narrowed as to permit the restriction of a fluid passing therethrough. The rings 38 to 41 are each formed of carbon or polyfluoroethylene and are so positioned that the thrusts acting, respectively, on the forward and rearward faces of the impeller 35 may be balanced.

The impeller 35 is provided with a plurality of subpumping bores 42 opened to a rearward face side of the impeller 35 at a position displaced from the ring 39 toward the center thereof. Each pumping bore 42 is opened also to the passage 37 of the impeller and assumes a logarithmic spiral (FIG. 3) so that when the impeller is rotated, the fluid may flow from the rearward face of the impeller into the passage 37. Said spherical, internally threaded cap 36 is provided with a plurality of subpumping bores 43, each of which similarly assumes a logarithmic spiral so that when the shaft is rotated, the fluid may flow from the through hole 26 of the shaft into the inlet 17. Note that said pumping bores 42, 43 may each be, for example, a one which radially outwardly extends in a linear manner without assuming a logarithmic spiral.

Said outlet 18 communicates with the rotor chamber 15 through a bore 44, a fluid intake passage 45 and a bore 46. The passage 45 has a restriction 47 and functions to send a fluid having a restricted pressure into the rotor chamber. This restriction 47 is so designed as to reduce the pressure of a pumped fluid to a level equal to one-fifth to one-tenth thereof. In the case of this embodiment, the restriction 47 reduces the pumped fluid pressure level of 3 kg/cm² to a level of 0.5 kg/cm². The fluid introduced through the passage 45 into the rotor chamber 15 is sent into the impeller chamber 16 through two cooling passages. A first cooling passage 52 for cooling the bearing faces associated with the first bearing ring 20 is comprised of an annular space 53 between the inner wall of the rearward housing 12 and the outer peripheral wall of the internal rotor 28, guide passages 54 between the guide vanes 50, the grooves **23*a*, 23*b* of the bearing ring 20, the through hole 26 of the shaft 25, and the subpumping grooves 43 of the threaded end cap 36. A second cooling passage 55 for cooling the bearing faces associated with the second bearing ring 22 is comprised of guide passages 56 between the guide vanes 51, the grooves 24*a*, 24*b* of the bearing ring 22, a low pressure space 57 at the rearward face side of the impeller 35, and the pumping grooves 42 of the impeller 35. Each groove 23*b* of the bearing ring 20 and each groove 24*b* of the bearing ring 22** have, respectively, limited areas so as to prevent the flow of a fluid of the amount extremely exceeding a value sufficient to cool the corresponding rings.

The operation of the pump according to said embodiment of the invention will now be explained.

When the motor shaft 33 of the electric motor (not shown) rotates the external rotor 31, the inner rotor 28 is rotated in synchronization with the external rotor 31 due to the magnetic connection between the permanent magnets 30 and 29, and simultaneously the shaft 25 and impeller 35 are rotated accordingly. For this reason, the fluid is taken from the inlet 17 into the passage 37 of the impeller and discharged under high pressure into the outlet 18 through the impeller chamber 16. Part of the high pressure fluid within the outlet 18 flows into the passage 45 and is pressure-reduced by the restriction 47 and then flows into the rotor chamber 15. This fluid is rotated due to a friction produced between this fluid and the internal rotor 28 in a direction in which the rotor 28 rotates, and partially flows along the guide vanes 50 to be introduced into the grooves **23*a* of the bearing ring 20, and subsequently flows into the grooves 23*b* to cool the bearing faces associated with the first bearing ring 20. Subsequently, this fluid flows into the through hole 26 of the shaft 25 and finally is returned from the subpumping grooves 43 to the impeller chamber 16 by a centrifugal force produced due to the rotation of the threaded cap 36. Another part of the fluid having flowed into the rotor chamber 15 flows into the grooves 24*a* of the bearing ring 22 along the guide vanes 51 and subsequently flows into the grooves 24*b* to cool the bearing faces associated with the second bearing ring 22. This fluid flows into the low pressure space 57 from the grooves 24*b* and then is discharged into the passage 37 of the impeller 35 through the pumping grooves 42. In this way, so long as the impeller 35 is rotated, the bearing rings 20 and 22 are independently alowed to cool by the first and the second cooling passages 52 and 55**, respectively.

During the normal operation of the pump, the impeller 35 is subject to a high pressure within the impeller chamber 16, while the internal rotor 28 is subject to a low pressure within the rotor chamber 15. As a result, the impeller 35 is balanced by relatively strong opposite axial thrusts acting respectively on the forward and rearward faces thereof, while the internal rotor 28 is balanced by relatively weak opposite axial thrusts acting respectively on the forward and rearward end faces thereof. Accordingly, the thrust balance of a whole rotating unit including the internal rotor 28 and the impeller 35 can be easily achieved by setting to appropriate values the pressure-receiving areas of the rotor 28 and impeller 35, respectively. When the impeller 35 is moved forwardly of FIG. 1 by the axial thrust acting thereon, the thrust ring 38 is allowed to abut against the thrust ring 40 and simultaneously the thrust ring 39 is separated from the thrust ring 41. For this reason, the fluid at the rearward face side of the impeller is passed through the interspace between the thrust rings 39 and 41 and in a pressure-reduced condition flows into the space 57 to cause the impeller 35 to be returned to the left. The fluid introduced into the space 57 is discharged into the passage 37 of the impeller 35 due to the pump action of the subpumping bore 42. Conversely, when the impeller 35 is moved leftwardly, the fluid at the forward face side of the impeller is allowed to escape into the inlet 17 through the interspace between the thrust rings 38 and 40 to cause the impeller 35 to be returned to the right.

Where, within the pump, a rapid increase in pressure such as that due to water hammer occures, this increased pressure is reduced by the restriction 47 while being transmitted from the outlet 18 to the rotor chamber 15 through the passage 45, and simultaneously is reduced by the associated opening means, especially the grooves **23*b*, 24*b* while being transmitted from the impeller chamber 16 to the rotor chamber 15 through the cooling passages. For this reason, the possibility of the wall of the rearward housing half 12** being expanded or damaged is eliminated.

Since the shaft 25 is supported by the bearing ring 22 not at the foward end but at the intermediate portion, such a spider-like bearing member as conventionally provided for the inlet 17 becomes unnecessary, whereby the cavitation occurring in the impeller chamber is decreased. Simultaneously, the span of a shaft portion between the bearing rings 20 and 22 is decreased, whereby the damage of the shaft 25 due to a stress is prevented.

Since, in the case of this embodiment, the inner wall of the rotor chamber 12 is provided with the guide vanes 50, 51, the fluid within the rotor chamber 12 is reliably allowed to flow radially inwardly toward the grooves **23*a*, 24*a***.

Figure 5:
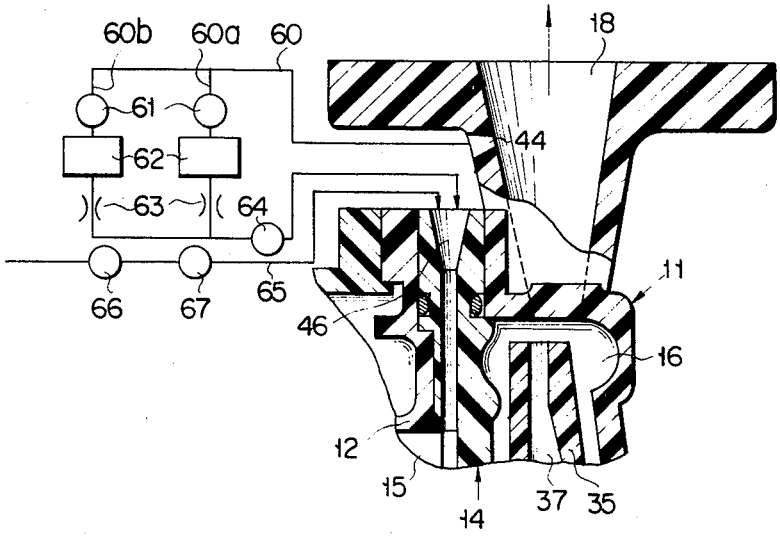
FIG. 5 is a schematic view showing a modified liquid intake section of the pump.

FIG. 5 shows a modification of the fluid intake passage. The remaining parts and sections are substantially the same as those of said embodiment, and therefore are omitted from FIG. 5.

Referring to FIG. 5, a fluid intake passage 60 connecting the outlet 18 with the rotor chamber 15 is branched into a pair of parallel passage sections **60*a* and 60*b*, each of which is provided with a directional control valve 61, filter 62 and restriction 63. Both passage sections 60*a* and 60*b* are unified again, and this unified passage section is provided with a float type or rotating type flow quantity indicator 64. Within the passage 60, the pressure of fluid is reduced to a level equal to one-fifth to one-tenth thereof. To the bore 46 communicating with the rotor chamber 15 is further connected one end of another water passage 65, the other end of which is connected to a water source not shown. The water passage 65 is provided with a directional control valve 66 and a flow quantity indicator 67**.

When the pump is in operation, the fluid is entered into the passage 60 through the bore 44 and passed through the valves 61, filters 62, throttles 63 and indicator 64 to flow into the rotor chamber 15. Since this fluid has its impurities removed by the filters 62, it is prohibited from damaging the bearing portion or blocking the associated grooves. Where, as in the case of, for example, muddy water, the fluid consists mainly of water and contains a large amount of impurities, the valves 61 are closed to permit a pure water to be sent from a water source not shown into the rotor chamber 15 through the water passage 65. In this case, a pressure drop does not occur in the outlet 18 and the bearing portion is kept clean, which offers a convenience.

The foregoing embodiments referred to the case where the pump had said separately provided passage 45 or 60 extending from the outlet 18 to the rotor chamber 15, but, according to the invention, instead of providing such separate passage, a hole or holes may be formed through the split plate 14 to allow the impeller chamber 16 to directly communicate with the rotor chamber 15 through such hole or holes. In this case, the hole or holes each have a limited cross-sectional area and itself acts as a restriction.

What is claimed is:

1. A magnetically driven centrifugal pump comprising a housing having a space provided therein, a split plate for dividing said space of said housing into a rotor chamber and an impeller chamber, an inlet and outlet connected to said impeller chamber, first and second bearing members fixed respectively to the inner wall of said rotor chamber and to said split plate, a shaft rotatably supported by said first and second bearing members respectively at its rearward end and intermediate portions and having its forward end portion projected into said impeller chamber, an internal rotor fixed to said shaft within said rotor chamber and having a plurality of first magnets, an external rotor disposed outside said housing and having a plurality of second magnets magnetically connected to said first magnets, a driving means for rotating said external rotor, an impeller fixed to said shaft within said impeller chamber, fluid intake passage means for guiding into said rotor chamber a fluid pumped by said impeller, resticting means for reducing the pressure of the fluid passing through said passage means, and cooling passage means for permitting the fluid sent from said rotor chamber to pass through said first and second bearing members thereby cooling said bearing members, the inner wall of said rotor chamber which is faced to the rearward face of said internal rotor being provided with first guide vanes extending toward said shaft, said first guide vanes defining first guide passages therebetween, said first guide passages being opened to the rotor chamber at their lengthwise sides and having such a configuration as to cause fluid rotating jointly with the internal rotor to positively flow through said first guide passages toward the shaft.

2. A magnetically driven centrifugal pump according to claim 1, wherein said cooling passage means includes a first cooling passage for cooling said first bearing member and a second cooling passage for cooling said second bearing member.

3. A magnetically driven centrifugal pump according to claim 2, wherein said first cooling passage includes cooling grooves formed in the bearing surface of said first bearing member, a through hole formed through said shaft, and at least one first pumping groove formed in a wall portion of said shaft in a direction in which it extends outwardly from the central axis of said shaft.

4. A magnetically driven centrifugal pump according to claim 3, wherein said shaft is provided with an end cap at its forward end, and said first pumping groove is formed in said end cap.

5. A magnetically driven centrifugal pump according to claim 3, wherein said first pumping groove describes a logarithmic spiral.

6. A magnetically driven centrifugal pump according to claim 2, wherein said second cooling passage includes cooling grooves formed in the bearing surface of said second bearing member, a space between the rearward face of said impeller and said split plate, and at least one second pumping groove formed in said impeller in a direction in which it extends outwardly from the central axis of said shaft.

7. A magnetically driven centrifugal pump according to claim 6, wherein said second pumping groove describes a logarithmic spiral.

8. A magnetically driven centrifugal pump according to claim 1, wherein said first guide vane describes a logarithmic spiral.

9. A magnetically driven centrifugal pump according to claim 1, wherein that portion of said split plate which is faced to the forward face of said internal rotor is provided with second guide vanes extending toward the shaft, said second guide vanes defining second guide passages therebetween, said second guide passages being opened to the rotor chamber at their lengthwise sides and having such a configuration as to cause fluid rotating jointly with the internal rotor to positively flow through said second guide passages toward the shaft.

10. A magnetically driven centrifugal pump according to claim 9, wherein said second guide vane describes a logarithmic spiral.

11. A magnetically driven centrifugal pump according to claim 1, wherein said fluid intake passage means includes a filter member for removing impurities from the fluid.

12. A magnetically driven centrifugal pump according to claim 11, wherein said fluid intake passage communicates with said outlet.

13. A magnetically driven centrifugal pump according to claim 1, which further comprises water passage means for sending water into said rotor chamber.

14. A magnetically driven centrifugal pump according to claim 1, wherein said impeller has first and second thrust ring members respectively at its forward and rearward faces; and the inner wall of said impeller chamber has third and fourth thrust ring members faced respectively to said first and second thrust ring members and forming restricted interspaces together with said first thrust ring member and said second thrust ring member, respectively.

15. A magnetically driven centrifugal pump according to claim 1, wherein said restricting means is so designed as to reduce the pressure of the pumped fluid to a level equal to one-fifth to one-tenth thereof.

* * * * *